United States Patent [19]

Carter

[11] Patent Number: 4,879,953

[45] Date of Patent: Nov. 14, 1989

[54] BULLET

[76] Inventor: Herman L. Carter, P.O. Box 262348, Houston, Tex. 77207

[21] Appl. No.: 261,755

[22] Filed: Oct. 24, 1988

Related U.S. Application Data

[62] Division of Ser. No. 11,582, Feb. 6, 1987, Pat. No. 4,793,037.

[51] Int. Cl.[4] ..... F42B 11/10

[52] U.S. Cl. ..... 102/507; 102/514

[58] Field of Search ..... 102/507-510, 102/514, 516

[56] References Cited

U.S. PATENT DOCUMENTS

| | | | |
|---|---|---|---|
| 2,333,091 | 11/1943 | Casnoff | 102/507 |
| 2,838,000 | 6/1958 | Schreiber | 102/507 |
| 3,003,420 | 10/1961 | Nosler | 102/514 |
| 4,044,685 | 8/1977 | Avcin | 102/508 |
| 4,336,756 | 6/1982 | Schreiber | 102/507 |
| 4,610,061 | 9/1986 | Halverson | 102/509 |
| 4,660,263 | 4/1987 | Kosteck | 29/1.23 |

OTHER PUBLICATIONS

*What Makes a Hunting Bullet* by Bob Hagel, Peterson's 1989 Hunting Annual, pp. 118-121.

"Big Game Bullet Bonanza" by Richard V. Underwood Handloader's Digest Fifth Edition 1970, pp. 100, 101, 297.

*Primary Examiner*—Harold J. Tudor

*Attorney, Agent, or Firm*—Vaden, Eickenroht, & Boulware

[57] ABSTRACT

A bullet is disclosed. The bullet comprises an outer jacket of cooper base material and an inner core of lead. The jacket includes a base portion and an ogive shaped cylindrical portion. The base portion has a higher yield point than the cylindrical portion so that the base portion will remain intact after impact with a game animal while the cylindrical section splits longitudinally and expands as the bullet travels into the target with a minimum in weight reduction.

11 Claims, 1 Drawing Sheet

FIG.1
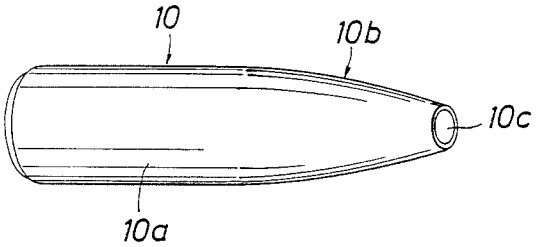
FIG. 2
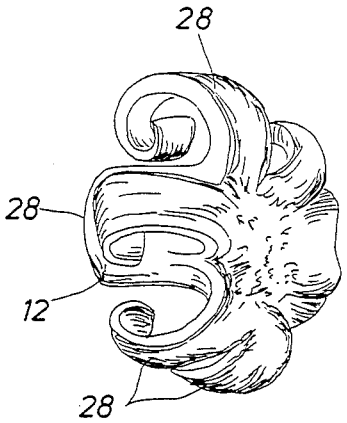
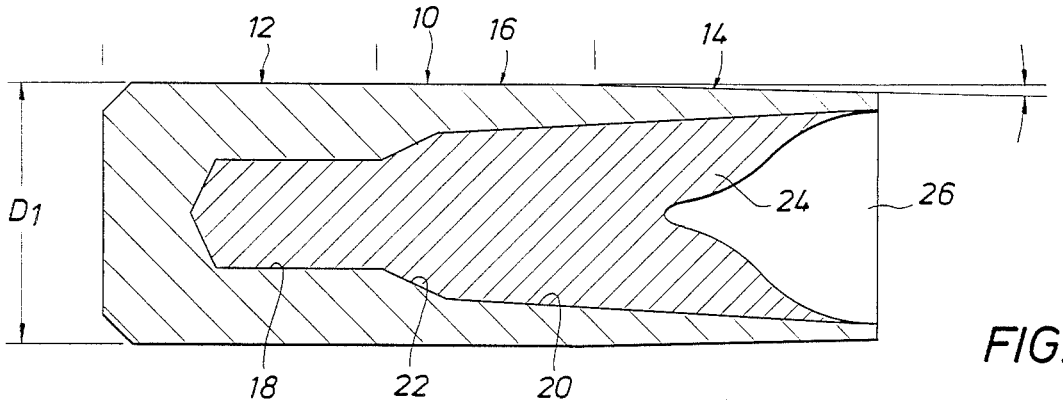
FIG. 3
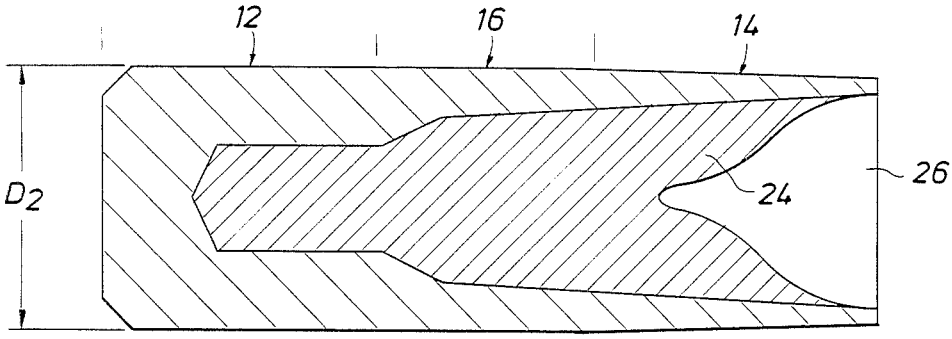
FIG. 4
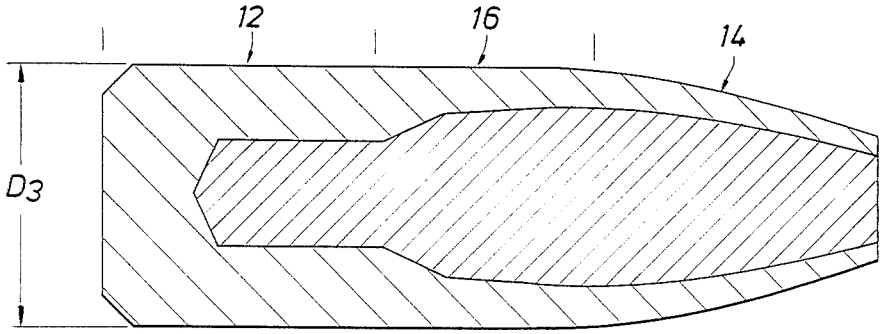
FIG. 5

BULLET

This application is a division of application Ser. No. 07/011,582, filed Feb. 6, 1987 entitled "Method of Making a Bullet", now U.S. Pat. No. 9,793,037.

This invention relates to bullets generally and, in particular, to bullets of the bonded core soft nose type used for hunting game, particularly large game animals ranging from deer to elephants.

Soft nose bullets are expected to expand in diameter as they penetrate game animals. The bullets have an outer jacket of a copper base material that may be pure copper or a copper alloy such as brass, and an inner core of lead. It is the peeling back or mushrooming of the outer jacket when the bullet strikes a game animal that produces the increase in diameter. It is important that the bullet expand in diameter, but it is also important that the bullet retain as much of its original weight as possible. Some bullets of this type can lose as much as 40%, 45%, or more of its total weight during the initial 4" to 8" of penetration which greatly reduces its effectiveness. For example, a 200 grain .308 bullet that loses 50% of its weight turns into a low velocity 100 grain .243 class bullet during the balance of its penetration of a game animal and its effectiveness is greatly reduced. Much of the weight loss is attributed to the loss of lead as the jacket peels backwardly, but a lot of the weight loss is due to the breaking off of the sections of jacket that peel back toward the rear of the bullet. By bonding the lead to the jacket, the lead loss can be reduced, but there is still a problem with the breaking off of the jacket sections that peel back as the bullet penetrates a game animal.

It is an object of this invention to provide a soft nose, bonded core bullet that consistently retains 90% or more of its weight with practically no loss of the peeled back sections of the jacket.

The peeled back sections are usually called "cutting claws". Big game bullets spin at between 108,000 to 223,000 revolutions per minute. The spinning cutting claws create a more lethal and humane bullet due to their sharp cutting edges, if they remain attached to the base of the bullet.

It is another object of this invention to provide a method of making a soft nose, bonded core bullet that has an outer jacket that increases in hardness, and therefore tensile strength, from the soft nose rearwardly toward the base of the bullet. This results in a much higher percentage of retention of the cutting claws.

It is a further object of this invention to provide a method of making a bullet having increased hardness and tensile strength from the nose to the base that includes work hardening the copper base jacket between the nose and the base of the bullet in varying amounts as the jacket is formed into the desired shape and caliber.

It is a further object of this invention to provide such a bullet and a method of making the same that includes forming the outer jacket to form a generally cylindrically-shaped solid base jacket out of copper base material, placing a predetermined amount of lead in the jacket, heating the jacket to a temperature sufficient to melt the lead and cause it to bond to the inner surface of the jacket and at the same time annealing the entire jacket to remove any stresses created in the jacket during the forming of the jacket, drawing the base of the jacket to a diameter less than the desired caliber to both harden the base material and to increase its tensile strength, placing the drawn jacket with the bonded core material in a die, and forming the bullet to the desired shape at the same time expanding the base of the jacket to the desired caliber thereby adding further work hardening to the material of the base while forming the nose of the bullet to the desired ogive design.

These and other objects, advantages, and features of this invention will be obvious to those skilled in the art from a consideration of this specification including the attached drawings and appended claims.

IN THE DRAWINGS;

FIG. 1 is an isometric view of a typical soft nose bonded core bullet of the type to which this invention relates.

FIG. 2 is an isometric view of a typical bullet of this invention after it has been recovered from a game animal showing how the forward part of the jacket splits longitudinally, generally along the grooves formed by the lands of the rifle as the bullet penetrates the animal, and curls backwardly over the base of the bullet to form cutting claws having very sharp edges to increase the lethal effect of the bullet while remaining attached to the base to retain substantially the original weight of the bullet as it penetrates the animal.

FIGS. 3, 4, and 5 illustrate the steps of the method of this invention that produces a bullet having the desirable features described above.

Bullet 10 in FIG. 1 has the typical shape of a soft nose, bonded core bullet. The outer jacket includes section **10*a* that is of the diameter required for the particular caliber of bullet and a tapered nose 10*b* that may be tapered along an ogive curve. The end of lead core 10*c*** can be seen through the open end of the jacket.

FIG. 3 of the drawing shows the condition of the bullet after the first three steps of the method of making the bullet of this invention have been performed. The first step is to form the outer jacket from a copper base material, such as machining the jacket from a solid rod of copper or brass. The jacket includes base portion 12 at one end and tapered nose portion 14 at the other end. Connecting these two portions of the jacket is transition portion 16. Base portion 12 is solid except for small diameter bore 18. For purposes of strength, it would be preferred to have the base made out of solid copper base material, but since lead weighs 1.26 times as much as the same volume of copper and it is sometimes important that the bullet have as great a mass as possible, bore 18 is provided to allow part of the base to be filled with lead. The wall between the bore and the outer surface of the base, however, is sufficiently thick for the base to retain its shape upon impact with a game animal.

Bore 20 of the jacket extends from the front of the jacket through nose portion 14 and partway through transition portion 16. Bore 20 is of decreasing diameter as it progresses toward the base so that the wall of the jacket decreases in thickness from where bore 20 ends in the transition portion to the open end of the bore. The outer surface of nose portion 14 is also tapered further decreasing the thickness of the wall toward the end of the jacket. Bore 20 is connected to bore 18 by a shorter bore 22 having a steeply inclined wall 22.

The outer diameter D1, of the base is larger than what the final diameter will be by an amount calculated to cause the metal of the base portion and the transition portion of the jacket to be work hardened sufficiently when formed to the proper caliber to have sufficient tensile strength to resist deformation upon impact with a game animal.

After the jacket has been formed in this manner, the proper amount of lead 24 is placed in the bore of the jacket. The jacket and the lead are then heated to a temperature sufficient to melt the lead and cause it to bond to the inner surface of the jacket. This also anneals the jacket and removes any stresses created in the jacket while it is being formed. As the jacket and lead cool, the lead will solidify and form shrink cavity 26 adjacent the open end of the jacket.

Next, the outer diameter of the jacket is drawn to diameter D2. This step work hardens the metal in base portion 12. It also work hardens the metal in transition portion 16 but to a lesser extent because of the smaller amount of metal involved. Diameter D2 is sufficiently smaller than the final diameter D3 to allow the jacket to be slid easily into the forming die that will give the bullet its final shape.

Thus, the next and last step in the method of manufacturing the bullet of this invention is to place the bullet, as shown in FIG. 4 in a forming die and force nose portion 14 into the ogived shape shown in FIG. 5. In the same operation, the outer diameter of intermediate portion 16 and base portion 12 will be expanded to that of the caliber of the bullet being manufactured. This further work hardens and strengthens these portions of the jacket. Nose portion 14 will also be work hardened to some extent as its outer walls are forced into the shape shown in FIG. 5. This work hardening will be very slight compared to the work hardening that occurs in the base. The work hardening of transition portions 16 will be less than that of the base, but more than that of nose portion 14.

Consequently, a bullet is produced having an outer jacket that is made out of progressively harder and higher tensile material, the hardness and yield strength of which increase from the nose to the base. As a result, when the bullet strikes and begins penetrating a game animal, nose portion 14 will be split longitudinally due to the forces resisting the forward movement of the bullet and peel or curl backwardly toward base portion 12, as shown in FIG. 2, forming a plurality of cutting claws 28. The distance the jacket splits will be limited by the increasing toughness and higher tensile strength of the work hardened material toward the base of the bullet. Further, with the increased tensile strength of the material toward the rear of the bullet, the tendency of the cutting claws to break off and be lost is substantially eliminated, allowing the bullet to maintain substantially its original weight.

From the foregoing it will be seen that this invention is one well adapted to attain all of the ends and objects hereinabove set forth, together with other advantages which are obvious and while are inherent to the method.

It will be understood that certain features and subcombinations are of utility and may be employed without reference to other features and subcombinations. This is contemplated by and is within the scope of the claims.

Because many possible embodiments may be made of the invention without departing from the scope thereof, it is to be understood that all matter herein set forth or shown in the accompanying drawings is to be interpreted as illustrative and not in a limiting sense.

What is claimed is:

1. A bullet comprising an outer jacket of copper base material and an inner core lead bonded to the jacket, said jacket including a base portion and an ogived shaped nose portion having a wall that decreases in thickness away from the base portion, said base portion having a tensile strength sufficiently higher than the nose portion for the base portion to remain intact after impact with a target while the nose portion splits longitudinally and expands as the bullet travels into the target with a minimum in weight reduction.

2. The bullet of claim 1 in which the base portion is drawn to increase the hardness and tensile strength of the base portion above that of the nose portion.

3. The bullet of claim 1 in which the jacket has a transition portion between the nose portion and the base portion and in which the base portion and at least part of the transition portion are work hardened.

4. The bullet of claim 1 in which the wall of the nose portion decreases in thickness to a thin edge at the forward end of the nose portion.

5. A bullet having an outer jacket of copper base material and an inner core of lead, said jacket including a base portion, an ogive-shaped nose portion, the walls of which decreases in thickness away from the base portion, and a transition portion between the base portion and the nose portion, said bullet being made by the method comprising the steps of forming the outer jacket from a rod of copper base material with the base portion and the transition portion having an initial outside diameter greater than the desired caliber and the walls of the nose portion being tapered inwardly, placing a predetermined amount of lead in the jacket, heating the jacket to melt the lead to cause the lead to bond to the inside surface of the jacket and to anneal the jacket to increase its ductility and reduce its hardness, drawing the outside diameter of the jacket to a diameter slightly less than the desired caliber to increase the tensile strength and hardness of the base portion of the jacket and to increase the tensile strength and hardness of the transition portion to a lesser extent, and forming the nose portion into the desired ogive curve while increasing the diameter of the base portion and the transition portion to the desired caliber to further increase the tensile strength and hardness of the base portion to provide a bullet that will remain intact after impact, a nose portion that is slightly work hardened by the forming operation and a transition portion that is work hardened more than the nose portion but less than the base portion so that the nose portion and at least part of the transition portion will split longitudinal into several sections that curl outwardly while remaining attached to and carried by the base to reduce the weight loss of the bullet to a minimum as it penetrates a target.

6. A bullet comprising an outer jacket of copper base material and an inner core of lead bonded to the jacket, said jacket including a base portion, a nose portion, and a transition portion between the base portion and the nose portion, said nose portion being ogived shaped with a wall that decreases in thickness away from the base portion, said copper base material of the jacket increasing in hardness and tensile strength from the nose portion to the base portion so that the base portion will reamin intact after impact with a target while the nose portion and at least part of the transition portion splits longitudinally and expands as the bullet travels into the target with a minimum in weight reduction.

7. The bullet of claim 6 in which the base portion is drawn to a diameter less than its finished diameter to increase the hardness and tensile strength of the base portion above that of the cylinder portion and thereafter expanded to its finished diameter to further increase its hardness and tensile strength.

8. The bullet of claim 6 in whcih the base portion and at least part of the transition portion are work hardened.

9. The bullet of claim 6 in which the wall of the nose portion decreases in thickness to a thin edge at the end of the nose portion.

10. The bullet of claim 6 in which the inner core of lead extends through the transition portion.

11. The bullet of claim 6 in which the inner core of lead extends part way through the base to increase the weight of the bullet.

* * * * *